US005362063A

United States Patent [19]

Cummings

[11] Patent Number: 5,362,063

[45] Date of Patent: Nov. 8, 1994

[54] FOLDING LAP BOARD

[76] Inventor: Clarence L. Cummings, 3437 229th St., Torrance, Calif. 90505

[21] Appl. No.: 218,437

[22] Filed: Mar. 28, 1994

[51] Int. Cl.[5] ..... A63F 3/00

[52] U.S. Cl. ..... 273/287; 273/285; 108/27; 108/63

[58] Field of Search ..... 273/274, 285, 287; 108/27, 63, 65, 67

[56] References Cited

U.S. PATENT DOCUMENTS

| | | | |
|---|---|---|---|
| 112,126 | 2/1871 | Cook | 273/285 X |
| 151,090 | 5/1874 | Chapman | 273/287 |
| 834,527 | 10/1906 | Klein | 273/285 X |
| 3,606,508 | 9/1971 | Barnes | 108/27 |
| 4,088,081 | 5/1978 | D'Arca | 108/27 |
| 4,312,507 | 1/1982 | Smith et al. | 273/287 X |
| 4,371,168 | 2/1983 | Dupuis | 273/285 X |
| 5,078,404 | 1/1992 | Barillaro et al. | 273/285 |
| 5,145,185 | 9/1992 | Yu et al. | 273/287 |

FOREIGN PATENT DOCUMENTS

| | | | |
|---|---|---|---|
| 2657534 | 8/1991 | France | 273/285 |

*Primary Examiner*—William E. Stoll

*Attorney, Agent, or Firm*—Charles H. Thomas

[57] ABSTRACT

A folding lap top game table is provided for two persons seated side by side and has a pair of flat, rigid rectangular panels joined together along mutually abutting straight interior edges. The lap table is provided with a raised ridge extending across its front and along its lateral side edges. The panels and the ridges of the lap top game table are covered by a fuzzy, high friction fabric, such as felt. The felt covering extends across the expanses of both the upper and lower surfaces of the hinged panels. The felt covering on the upper surfaces of the panels prevents objects placed thereon from sliding across the top of the game table. At the same time the felt covering on the lower surfaces aids in preventing the lap top game table from sliding off of the laps of the users. When not in use the lap top table may be folded in half for compact storage.

19 Claims, 2 Drawing Sheets

FOLDING LAP BOARD

BACKGROUND OF THE INVENTION

1. Field of the Invention

The present invention relates to a folding lap table designed to be used by two persons while seated.

2. Description of the Prior Art

Over the years various types of lap tables have been designed for use by persons while seated. A conventional lap table involves a board or other rigid, flat surface, which an individual can place across his or her thighs while seated and which will support objects that can be utilized by the person while seated. For example, lap boards are particularly useful to persons seated for lengthy periods of time, such as passengers in busses, trains, automobiles and other vehicles. A lap board allows a passenger in such conveyances to play card games, or to engage in other forms of amusement such as dominoes, Yahtze, crossword puzzles, tic-tac-toe and other diversions that help pass the time when one is seated in a confined manner for lengthy periods of time. Lap boards are also particularly useful to persons confined to hospital beds, persons seated in waiting rooms and persons seated on folding chairs at public gatherings, such as graduation ceremonies, recitals and meetings. Under these latter conditions lap boards are particularly useful to allow small children to amuse themselves and not disrupt others, since youngsters can quickly become bored with such proceedings.

A recurring problem which has persisted through the years in the design of conventional lap boards is that the objects placed on the lap boards can readily slip off and fall to the floor. Also, the lap boards themselves can easily slide off the lap of the user. For example, U.S. Pat. No. 151,090 discloses a lap table in which two thin leaves of board are united by hinges, whereby one leaf may be closed upon the other. Around the free edge of each board there is a rim projecting slightly above the upper surface of the leaves. The rim prevents a cup or plate or anything else from easily slipping off. Holes may be made of sufficient size to receive a cup and securely hold it at any point or points upon the leaves. On the underside of the leaves there is a brace arranged to slide and bind across a hinged joint when the leaves are opened, or to slide back and permit them to close when desired.

While this prior device does provide a lap table having a rim that aids in preventing objects from sliding completely off of the lap table, objects can easily slide across the surface of the table until they meet the rim. Thus, if the user is jostled in any way, the arrangement of objects on the lap table can easily be disorganized. That is, the arrangement of cards in a card game, the arrangement of dominoes, or the arrangement of numerous other amusement devices can easily be scattered across this conventional type of lap board. This represents a source of continuing annoyance and discouragement to the user. Also, a device of the type described in U.S. Pat. No. 151,090 can easily slide off of a person's lap.

While numerous other different types of lap tables of more recent design have been devised, they all entail the same disadvantages described with respect to U.S. Pat. No. 151,090. Thus, the problem of articles sliding across the surface of a lap table and the problem of the lap table itself sliding from the lap of a user have existed for many, many years.

Also, lap boards have previously been designed so that they can only be used by a single person. Thus, conventional lap boards are inconvenient when playing competitive games since they are always on the lap of only a single participant.

SUMMARY OF THE INVENTION

The present invention is directed toward a folding lap top table constructed in such a way that it not only avoids the disadvantages of the prior art but can be used by two persons. That is, the lap table of the present invention is constructed so as to retard objects from sliding across its surface. This prevents the constant disruption of games played by two players such as dominoes, cribbage, two handed pinochle and other competitive diversions in which objects are placed in a precise arrangement where they are to remain until purposefully used.

Another object of the invention is to provide a folding lap board that is unlikely to slide from the lap of either user. Thus, the lap board of the invention provides a high coefficient of friction on its upper surface to prevent objects from sliding across its upper surface, and also a high coefficient of friction on the peripheral regions of its lower surface to prevent the lap board from sliding off of the legs of the users.

The present invention is a folding, lap top game table which has ridges on its top around three sides and which folds at the center. The game table is hinged on the bottom so that when it is folded the ridges project outwardly and the bottom sides of the bi-folding sections are substantially flat and reside in contact with each other.

The game table is covered on the top with felt cloth or some other fuzzy fabric which is not slick but which provides a measure of traction. The cloth covering wraps over the ridges and the edges of the game table sections about the entire exposed peripheries so as to extend under the edges on the bottom. The cloth material has fibers that project from the upper and lower surfaces of the panels so as to provide good traction.

The users are seated side by side and position the lap game table in an unfolded condition so that it extends across both of their laps with the long ridged front edge remote from the users' bodies and with the rear edge having no ridge against the users' waists. Because the game table rests on the laps of both users, the felt on the front ridged edge of the game table that wraps around the underside thereof provides a measure of frictional adherence to the clothing on the users' legs. Thus, the game table does not easily slide off the users' laps. Also, since the top surface is covered with felt, or some other fuzzy fabric, cards, small figures, or other objects placed on the top of the game table surface will not tend to slide about. The ridges at the sides and in the front of the folding game table provide a barrier to prevent articles from sliding off of the flat game table surface.

The game table of the invention may be utilized in numerous different situations, such as by two persons while traveling side by side on a bus, train or airplane, while seated in chairs which have no table, on a bench, or at the beach on a blanket. Two users may play a card game, such as pinochle, put together a puzzle, play cribbage, or engage in other entertainment activities in which a flat surface is very helpful or a necessity, but where other flat surfaces are not readily available. The lap table of the invention may also be used by a single person, if desired.

In one broad aspect the present invention may be considered to be a folding lap table comprising: a pair of flat, rigid panels each having an upper surface and a lower surface, a forwardly facing front edge, a rearwardly facing back edge, a laterally outwardly facing side edge, and an interior edge; a raised rim on the upper surfaces of both the panels extending along the front edges and the side edges thereof; a hinge joining the panels at their interior edges so that the lower surfaces of the panels fold together into mutual juxtaposition and apart into mutual coplanar relationship; and separate fabric covering on each of the panels extending across the upper surfaces, over the rims, and onto the lower surfaces thereof. Preferably the fabric coverings are formed of a cloth material having fibers that project from the upper and lower surfaces of the panels. One suitable fabric covering is felt, since felt provides a relatively high coefficient of friction and does not present a slick or slippery surface.

The fabric coverings on each of the panels extend across the peripheral regions of the lower or undersurfaces of the panels, all the way around the exposed perimeters of the panels to the hinge or hinges that join the panels at their interior edges. By providing the covering on a portion of the lower surfaces of the panels, the felt or other fabric covering on the panels tends to cling to the fabric of the user' trousers, dresses, and even the bare skin of the upper legs of the two users who may be wearing shorts or swimming attire.

Preferably the panels are rectangular in shape and are constructed in mirror image configurations. The ridges on the front and laterally facing side edges of the panels preferably project upwardly from the upper surfaces of the panels to a height of about one half of an inch. The cloth covering on the panels is wrapped over the ridges and extends across the outer periphery of the underside or lower surfaces of the panels. A lap table of suitable size for two persons seated side by side may be formed in which each of the panels is of a rectangular configuration, about eleven inches by fourteen inches and in which the panels are joined along their shorter, mutually adjacent edges.

The invention may be described with greater clarity and particularity by reference to the accompanying drawings.

DESCRIPTION OF THE EMBODIMENT

Figure 1:
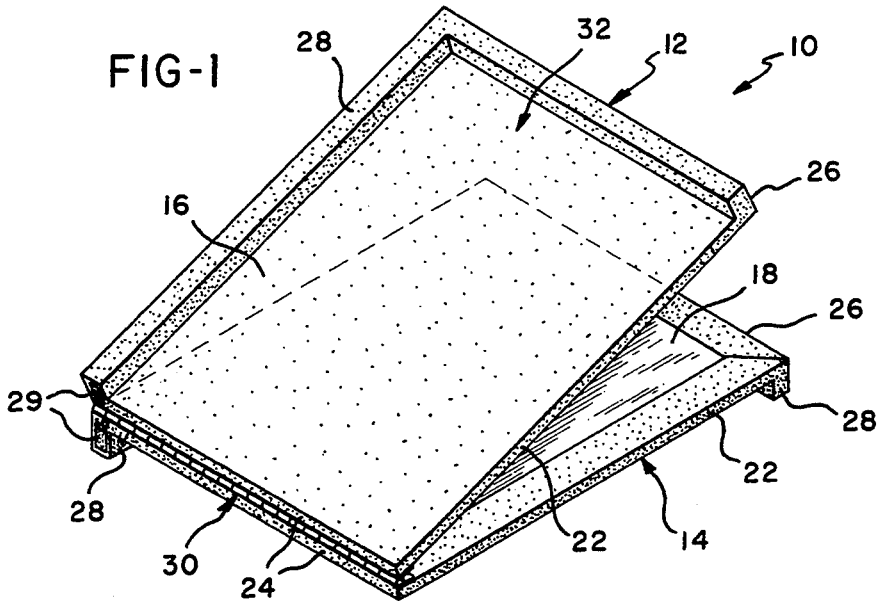
FIG. 1 is a perspective view showing the lap table of the invention being folded.

The drawings illustrate a folding lap top table indicated generally at 10 formed of a pair of flat rigid panels 12 and 14. Each of the panels 12 and 14 has an upper surface 16, a lower surface 18, a front edge 20, a rear edge 22, an interior edge 24 and a laterally facing side edge 26. There is a raised rim 28 extending in an L-shape on the upper surfaces 16 of both of the panels 12 and 14. The rim 28 extends along the front edge 20 and the laterally facing side edge 26 of each of the panels 12 and 14.

Figure 4:
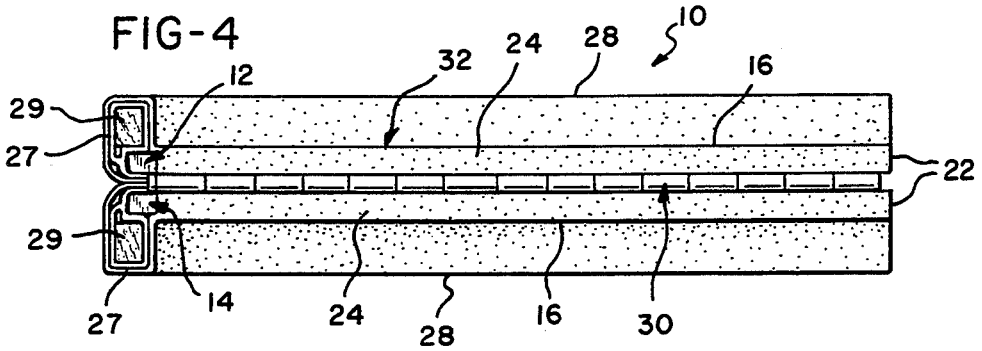
FIG. 4 is a side elevational view looking toward the mutually adjacent interior edges of the panels showing the lap table in its folded position.
Figure 5:
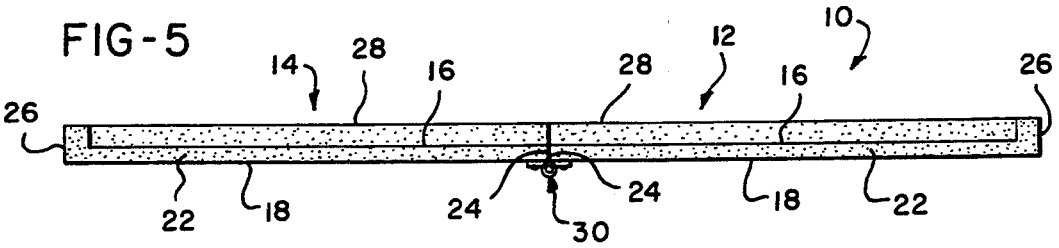
FIG. 5 is a rear elevational view taken along the lines 5—5 of FIG. 2.
Figure 3:
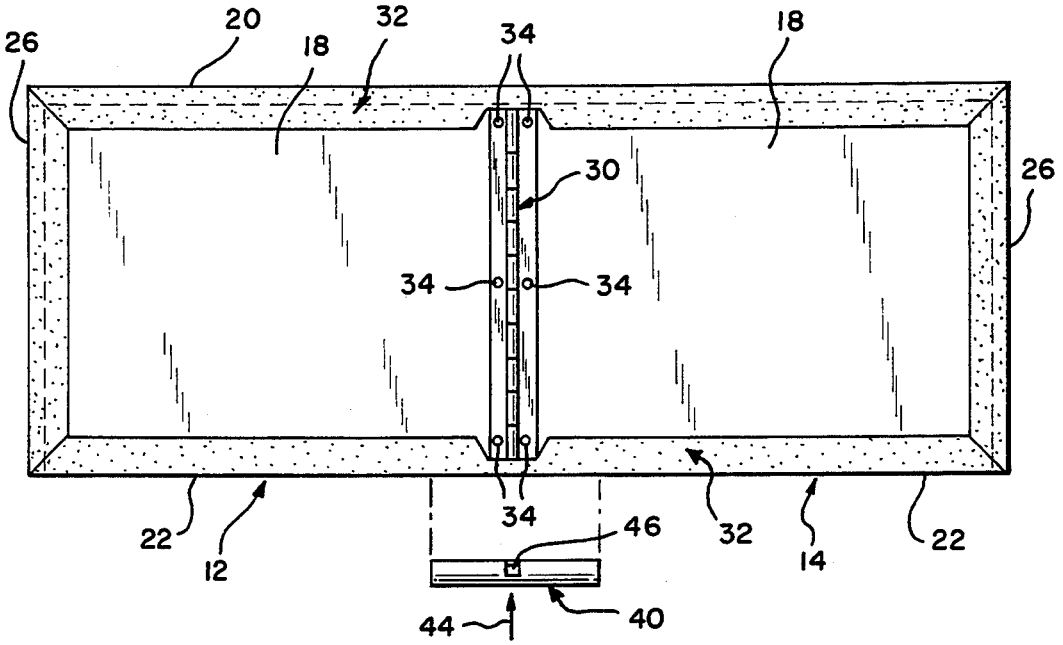
FIG. 3 is a bottom plan view of the lap table unfolded as shown in FIG. 2.

As best shown in FIGS. 1 and 3, a hinge 30 joins the panels 12 and 14 together along their mutually abutting interior edges 24. The panels 12 and 14 are thereby foldable so that their lower surfaces face each other, as depicted in FIGS. 1 and 4. The panels 12 and 14 are alternatively unfoldable so that their upper surfaces 16 reside in mutually coplanar relationship, as do their lower surfaces 18, as illustrated in FIG. 5. Each of the panels 12 and 14 is provided with a fabric felt covering 32 that extends across the entire expanses of the upper surfaces 16 over the rims 28 and onto the lower surfaces 18. The fabric coverings 32 of each of the panels extend around the exposed periphery of the lower surfaces 18 up to the hinge 30, as illustrated in FIG. 3.

In constructing the lap board 10, the panels 12 and 14 and the felt coverings 32 are first cut to size. The panels 12 and 14 are both preferably cut in a rectangular configuration from masonite that is one eight of an inch thick. Each of the panels 12 and 14 measures eleven inches by fourteen inches. The mutually abutting interior edges 24 and the laterally outwardly facing edges 26 of the panels 12 and 14 are all eleven inches in length, while the front edges 20 and back edges 22 are all fourteen inches in length. The rough side of the masonite board serves as the upper surface 16 while the smooth side serves as the lower surface 18.

The exposed edges 20, 22 and 26 of the panels 12 and 14 are finished with strips 27 of three quarter inch tubular aluminum screen framing, which form the rim 28. The strips 27 of the aluminum framing are first notched at the transition between the front edges 20 and laterally outwardly facing edges 26 and are bent into an L-shaped configuration. The edges 26 of the panels 12 and 14 are then dipped into a shallow paint tray containing paint, which in the construction according to the invention serves as glue. The panels are then rotated ninety degrees to dip the edges 20 into the paint. The edges 20 and 26 of the masonite panel 12 and 14 are then inserted into the channels provided in the screen framing strips 27 that would normally receive the compressible beading that secures the screen in the frame. The masonite panels 12 and 14 are of a thickness such that they fit snugly into these channels, as illustrated in FIG. 4. Furthermore, the paint on the edges 20 and 26 of the panels 12 and 14 serves as an adhesive to securely attach the aluminum screen framing strips 27 to the panels 12 and 14.

Since the ends of the aluminum framing strips 27 may form sharp edges, it is advisable to fill them with some medium which will prevent users from being accidently scratched. For this purpose the rim 28 is provided with short strips of wood 29 one half inch in width, three eighths of an inch in height and two inches in length. The wooden strips 29 are pushed into the rectangular cavities defined within the tubular aluminum screen framing strips 27 at the exposed ends thereof adjacent the corners of the panels 12 and 14 where the front edges 20 meet the interior edges 24 and also adjacent the location at which the outwardly facing edges 26 meet the rear edges 22. Two short strips of wood 29 are employed for each of the panels 12 and 14, one each being pushed into the exposed ends of the aluminum strips 27.

Once the short wooden strips 29 have been inserted into the ends of the rectangular cavities defined by the tubular aluminum strips 27, they are secured in place by placing a screw driver on top of the rim 28 near the ends of the strips 27 and tapping the screw driver with a hammer to create small indentations or dimples in the aluminum strips 27 thereby longitudinally immobilize the wood strips 29 therewithin. That is, by using a hammer and screwdriver small detent depression can be created in the screen framing strips 27.

Following attachment of the rim 28, the hinge 30 is attached to join the panels 12 and 14 together along their mutually interior edges 24. The hinge 30 is a strip hinge about ten and one quarter inches in length. The hinge 30 is fastened to the lower surfaces 18 of the panels 12 and 14 at the mutually abutting panel edges 24 by six rivets 34, as shown in FIG. 3. To attach the rivets 34, holes are first drilled in the panels 12 and 14 near their edges 26 and the rivets are inserted with their heads on the upper surface 16. The hinge 30 terminates just short of the edges 20 and 22 at the ends of the edges 24.

Following attachment of the panels 12 and 14 utilizing the hinge 30, the fabric coverings 32 are then attached to the panels 12 and 14. The fabric covering 32 have fuzzy exposed surfaces, and are formed of felt cloth one sixteenth of an inch thick. The fibers of the felt that project outwardly from the upper and lower surfaces 16 and 18 of the panels 12 and 14 form a non-slippery, high friction surface. This aids in preventing articles, such as the playing cards and scorecard illustrated in FIG. 2 from sliding across the upper surfaces 16 of the panels 12. Likewise, the high friction of the felt cloth on the lower surfaces 18 of the panels 12 and 14 aids in preventing the lap table 10 from sliding off of the laps of the users.

Figure 2:
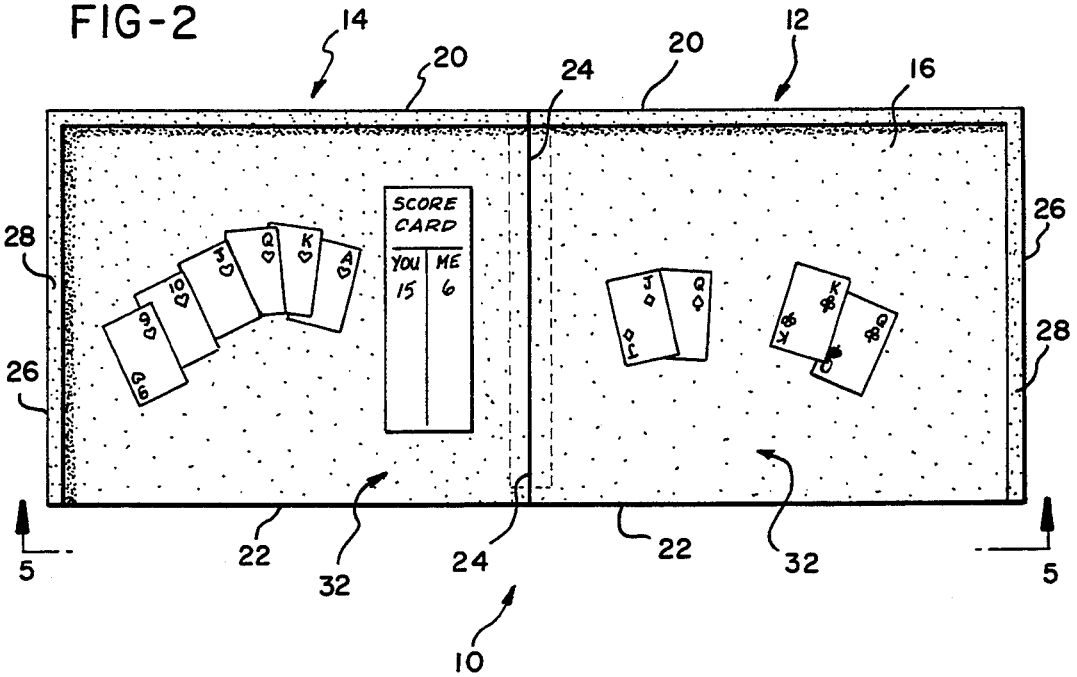
FIG. 2 is a top plan view showing the upper surface of the lap table of the invention in use.

To attach the felt coverings 32 to the panels 12 and 14, a strip of adhesive is preferably laid down about an inch wide on the upper surfaces 16 adjacent the mutually facing interior edges 24 of the panels 12 and 14. The felt cloth coverings 32 are then positioned and attached at these locations along the strips of adhesive in such a manner that the portions of the felt material 32 adjacent the edges 24 can be wrapped over and will extend down between the facing edges 24. Adhesive is applied to the mutually facing edges 24 before wrapping the felt covering over these edges. Even though the edges 24 are concealed from view when the lap board 10 is utilized, it is advisable to cover the edges 24 with felt to prevent a persons skin from being pinched in between the edges 24 when the lap board is unfolded from the stored position of FIG. 4 to the extended position in which it is used as depicted in FIGS. 2 and 5.

Once the felt has been secured to cover the edges 24, adhesive is sprayed across the remainder of the upper surfaces 16 of the panels 12 and 14, onto the ridges 28, and onto the peripheral regions of the lower surfaces 18 adjacent the edges 20, 26 and 22 of the panels 12 and 14.

The felt coverings 32 are then spread across the upper surfaces 16, with care being taken to press the material of the felt coverings 32 into the corners at the interfaces of the upper surfaces 16 with the rims 28. The felt coverings 32 are then smoothed with a hot iron. The portions of the felt coverings 32 on the upper surfaces 16 are then wrapped about the rims 28 and pressed across the peripheral regions of the lower surfaces 18 of the panels 12 and 14 adjacent the edges 20, 22 and 26 thereof, as illustrated in FIG. 3. The only portions of the panels 12 and 14 that are left exposed and that are not covered by either the felt coverings 32 or the leaves of the hinge 30 are the interior regions of the lower surfaces 18, as shown in FIG. 3.

The portable lap table 10 may be folded as illustrated in FIG. 1. Since the hinge 30 is attached to the lower surfaces 18 of the panels 12 and 14, the lower surfaces 18 of the panels reside in mutually facing disposition as illustrated in FIG. 4 when the lap table 10 is folded for storage.

When the lap table 10 is to be utilized, it is unfolded from the position of FIG. 4 to the extended or unfolded position illustrated in FIG. 5. In this disposition the felt covered interior edges 24 of the two mirror image panels 12 and 14 are brought into mutual abutment, and the upper surfaces 16 of the panels 12 and 14 are in a mutually coplanar, horizontal disposition. Likewise, the lower surfaces 18 of the panels 12 and 14 are also in a mutually coplanar, horizontal disposition.

The raised rims 28 that extend about the laterally outwardly facing edges 26 and across the front edges 20 of the panels 12 and 14 extend in a U-shape on the top surface of the lap table 10 and serve as a retaining barrier that prevents articles from sliding off of the lap table 10 when it is in use. However, the felt coverings 32 that cover the upper and lower surfaces 16 and 18 of the panels 12 and 14 is of even greater significance and provides frictional restraint. The felt on the upper surfaces 16 of the panels 12 and 14 prevents the playing cards illustrated in FIG. 2 from sliding out of their precise alignment even though the users are jostled or experience bumps when riding as passengers or even when the game board 10 is inadvertently tipped from a horizontal disposition. The frictional restraint provided by the felt coverings 32 prevents the cards and other articles from sliding across the upper surfaces 16 of the panels 12 and 14 under such conditions.

In addition, the felt coverings 32 extend across the exposed peripheral edges of lower surfaces 18 of the panels 12 and 14, all the way up to where the edges of the coverings 32 meet the hinge 30. Thus, the peripheries of the lower surfaces 18 of the panels 12 and 14 are likewise covered with a high friction, non-slippery material that tends to cling to the garments or legs of the user.

In use the lap board panels 12 and 14 each normally reside on the laps of two people side by side. That is, the panel 12 resides on the lap of a person seated to the right, as viewed in FIG. 2, while the lap board panel 14 rests on the lap of a person seated to the left as viewed in the same drawing figure. Thus, the lap board 10 is supported at both ends, rather than at the center underneath the hinge 30. As a consequence, it will not tend to fold up when in use.

Figure 6:
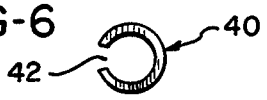
FIG. 6 is an end view of the optional accessary shown in FIG. 4 for preventing the lap table from following while in use.

On the other hand, when the lap board 10 is to be moved about, it may be advisable to provide a means for preventing the hinge from folding. This can be done by providing about a six inch length of an annular, tubular section 40 of conventional stiff PVC tubing having an inner diameter of one half inch and an outer diameter of three quarters of an inch, shown in FIG. 3. The tubing has a wall thickness of about one eighth of an inch. A longitudinal gap one quarter inch in width is cut along the length of the tubing section 40 to configure the tubing into a C-shaped cross section, as illustrated in FIG. 6. Due to the gap 42 along its length, the tubing section 40 can be moved laterally toward the rear edges 22 of the panels 12 and 14 in an orientation parallel thereto, as indicated by the directional arrow 44 in FIG. 3. The edges of the tubing section 40 adjacent the gap 42 will thereby grip the upper and lower surfaces of the panels 12 and 14 and the tubing section 40 will span the hinge 30. A transverse arcuate slot 46 is cut in the lower side of the tubing section 40 to receive the knuckles of the hinge 30 when the tubing section 40 is pushed onto the edges 22 of the panels 12 and 14.

The tubing section 40 thereby serves as a lock to prevent the hinge from closing. When it is desired to fold the lap board 10, as shown in FIG. 1, the tubing section 40 is pulled free from the edges 22 of the panels 12 and 14. This allows the panels 12 and 14 to be folded together as illustrated in FIGS. 1 and 4.

The folding lap board of the invention serves the users as a convenient, lap top game table having soft but high friction surfaces. Unlike conventional lap boards, the lap board of the present invention provides a means for preventing disruption of precisely laid objects, such as cards, dominoes, and other game pieces. Also, the high friction on the undersurface of the game board restrains the board from slipping off of the laps of a users.

Undoubtedly, numerous variations and modifications of the invention will become readily apparent to those familiar with folding lap boards. Accordingly, the scope of the invention should not be construed as limited to this specific embodiment depicted and described, but rather as defined in the claims appended hereto.

I claim:

1. A folding lap table comprising:

a pair of flat, rigid panels each having an upper surface and a lower surface, a forwardly facing front edge, a rearwardly facing back edge, a laterally outwardly facing side edge, and an interior edge, a raised rim on said upper surfaces of both said panels extending along said front edges and said side edges thereof, a hinge joining said panels at their interior edges so that said lower surfaces of said panels fold together into mutual juxtaposition and apart into mutual coplanar relationship, and separate fabric coverings on each of said panels extending across the entire expanses of said upper surfaces, over said rims and onto said lower surfaces thereof.

2. A folding lap table according to claim 1 further comprising a releasable lock to hold said panels extended with said lower surfaces in mutual coplanar relationship as aforesaid.

3. A folding lap table according to claim 1 wherein said fabric coverings have fuzzy exposed surfaces.

4. A folding lap table according to claim 1 wherein said fabric coverings are formed of felt.

5. A folding lap table according to claim 1 wherein said panels are rectangular in shape.

6. A folding lap table according to claim 1 wherein said ridge projects upwardly from said upper surfaces of said panels about one half of an inch.

7. A folding lap table comprising:

a pair of flat, rigid panels each having an upper and a lower surface, front and rear edges, an interior edge and a laterally facing side edge, a raised rim on said upper surfaces of both of said panels extending along said front and laterally facing side edges thereof, a hinge joining said panels together along their interior edges, whereby said panels are foldable so that their lower surfaces face each other and are unfoldable so that their upper surfaces reside in mutually coplanar relationship, and a fabric covering on each of said panels extending across the entire expanses of said upper surfaces, over said rims, and onto said lower surfaces thereof.

8. A folding lap table according to claim 7 further comprising a releasable means for holding said upper surfaces of said panels in mutually coplanar relationship as aforesaid.

9. A folding lap table according to claim 7 wherein said fabric coverings have fuzzy exposed surfaces.

10. A folding lap table according to claim 7 in which said fabric coverings are felt.

11. A folding lap table according to claim 7 in which said rim is about one half of an inch in height.

12. A folding lap table according to claim 7 in which each of said panels is about eleven inches by fourteen inches in size.

13. A lap table comprising:

a pair of flat, rigid, panels shaped in mirror image configurations each having an upper and a lower surface, a mutually abutting straight interior edge, a forwardly facing front edge, a laterally facing side edge, and a rearwardly facing back edge, rims on each of said panels rising from said upper surfaces thereof and extending along said forwardly facing front edges and along said laterally facing side edges, a hinge attached to join said panels together at their mutually abutting straight interior edges, whereby said panels fold together with their lower surfaces disposed in abutment against each other, and said panels alternatively unfold so that their upper surfaces reside in coplanar disposition with each other, and fabric coverings extending across said upper surfaces, over said rims and onto said lower surfaces of both said panels.

14. A lap table according to claim 13 wherein said fabric coverings are formed of a cloth material having fibers that project from said upper and lower surfaces of said panels.

15. A lap table according to claim 14 in which said cloth material is felt.

16. A lap table according to claim 14 in which said rims project upwardly from said upper surfaces of said panels a distance of about one half of an inch.

17. A lap table according to claim 14 in which each of said panels has a rectangular shape.

18. A folding lap top table according to claim 14 further comprising a releasable lock which, when engaged, grips said rearwardly facing back edges and spans said hinge so as to hold said panels unfolded as aforesaid.

19. A lap table according to claim 13 in which said front and back edges of each panel are each about fourteen inches in length and said interior edges and said laterally facing side edges are each about eleven inches in length.

* * * * *